US010647939B2

(12) United States Patent
Chen et al.

(10) Patent No.: US 10,647,939 B2
(45) Date of Patent: May 12, 2020

(54) THIADIAZOLE COMPONENTS, COMPOSITIONS, AND METHODS

(71) Applicant: INTERNATIONAL PETROLEUM PRODUCTS & ADDITIVES COMPANY, INC., Dublin, CA (US)

(72) Inventors: Xingguo R. Chen, Henrico, VA (US); Jeffrey A. Crow, Midlothian, VA (US); Troy R. Haynes, Glen Allen, VA (US); Jonathan A. Crow, Midlothian, VA (US); Brian J. Cereghino, Dublin, CA (US)

(73) Assignee: International Petroleum Products & Additives Company, Inc., Dublin, CA (US)

( * ) Notice: Subject to any disclaimer, the term of this patent is extended or adjusted under 35 U.S.C. 154(b) by 0 days.

(21) Appl. No.: 15/356,066

(22) Filed: Nov. 18, 2016

(65) Prior Publication Data

US 2018/0142181 A1 May 24, 2018

(51) Int. Cl.

| | |
|---|---|
| ***C10L 1/22*** | (2006.01) |
| ***C10M 135/36*** | (2006.01) |
| ***C07C 309/62*** | (2006.01) |
| ***C10M 141/08*** | (2006.01) |
| ***C10M 139/00*** | (2006.01) |
| *C10N 30/04* | (2006.01) |
| *C10N 30/12* | (2006.01) |
| *C10N 50/10* | (2006.01) |

(52) U.S. Cl.

CPC ..... *C10M 135/36* (2013.01); *C10M 139/00* (2013.01); *C10M 141/08* (2013.01); *C10M 2207/027* (2013.01); *C10M 2207/34* (2013.01); *C10M 2215/28* (2013.01); *C10M 2215/30* (2013.01); *C10M 2217/043* (2013.01); *C10M 2219/044* (2013.01); *C10M 2219/088* (2013.01); *C10M 2219/106* (2013.01); *C10N 2030/04* (2013.01); *C10N 2030/12* (2013.01); *C10N 2050/10* (2013.01); *C10N 2210/01* (2013.01); *C10N 2210/02* (2013.01); *C10N 2230/04* (2013.01); *C10N 2230/12* (2013.01); *C10N 2250/10* (2013.01); *C10N 2260/14* (2013.01)

(58) Field of Classification Search

CPC ..... C10M 13/44; C10M 2219/106; C10M 135/20; C10M 129/26; C10M 135/10

USPC ..... 508/192, 231, 390

See application file for complete search history.

(56) References Cited

U.S. PATENT DOCUMENTS

| | | | | |
|---|---|---|---|---|
| 3,087,932 | A | 4/1963 | Little, Jr. | |
| 3,663,561 | A | 5/1972 | Blaha | |
| 3,929,652 | A | 12/1975 | Seni et al. | |
| 4,188,297 | A | 2/1980 | Jayne et al. | |
| 4,188,299 | A | 2/1980 | Caspari | |
| 4,210,544 | A | 7/1980 | Burton et al. | |
| 4,260,501 | A | 4/1981 | Shim | |
| 4,487,706 | A | 12/1984 | Lam | |
| 4,623,474 | A | 11/1986 | Holstedt et al. | |
| 4,925,580 | A | 5/1990 | Camenzind | |
| 5,152,909 | A | 10/1992 | DeRosa et al. | |
| 5,360,565 | A | 11/1994 | Junga | |
| 5,622,922 | A | 4/1997 | Clarke et al. | |
| 5,641,730 | A | 6/1997 | Brown | |
| 5,653,787 | A | 8/1997 | Poirier | |
| 5,759,965 | A | 6/1998 | Sumiejski | |
| 6,689,723 | B2 | 2/2004 | Sullivan et al. | |
| 6,806,241 | B2 | 10/2004 | Karol et al. | |
| 7,176,168 | B2 | 2/2007 | Vann et al. | |
| 7,381,691 | B2 | 6/2008 | Adams et al. | |
| 7,396,802 | B2 | 7/2008 | Mondal et al. | |
| 2004/0102336 | A1* | 5/2004 | Boffa | C10M 163/00 508/199 |
| 2004/0214730 | A1 | 10/2004 | Buitrago | |
| 2006/0035791 | A1 | 2/2006 | Donnelly et al. | |
| 2006/0240998 | A1 | 10/2006 | Sullivan et al. | |
| 2006/0264341 | A1* | 11/2006 | Culley | C10M 133/44 508/271 |
| 2009/0215657 | A1 | 8/2009 | Ripple | |
| 2010/0016189 | A1 | 1/2010 | Baker et al. | |
| 2010/0075875 | A1* | 3/2010 | Yaguchi | C10M 169/04 508/192 |

(Continued)

FOREIGN PATENT DOCUMENTS

| | | | |
|---|---|---|---|
| EP | 0045827 | B1 | 11/1983 |
| EP | 0135778 | A2 | 4/1985 |
| EP | 0395258 | A1 | 10/1990 |

OTHER PUBLICATIONS

Baderna et al., "Lubricants and Additives: A Point of View," Global Risk-Based Management of Chemical Additives I: Production, Usage and Environmental Occurrence, Hdb Env Chem, 2012, vol. 18, Abstract.

(Continued)

*Primary Examiner* — Prem C Singh

*Assistant Examiner* — Francis C Campanell

(74) *Attorney, Agent, or Firm* — Eversheds Sutherland (US) LLP

(57) ABSTRACT

Provided herein are compositions that include a thiadiazole component and a solubility enhancing component. The solubility enhancing component can include a dispersant, a detergent, or both a dispersant and a detergent. The thiadiazole component can include one or more species having a hydrocarbyl-disulfanyl moiety. The compositions may be used as a corrosion inhibitor. Also provided herein are methods for making a thiadiazole component and a composition.

11 Claims, No Drawings

(56) References Cited

U.S. PATENT DOCUMENTS

| | | | | |
|---|---|---|---|---|
| 2010/0130390 | A1* | 5/2010 | Tipton | C10M 141/10<br>508/162 |
| 2012/0108477 | A1* | 5/2012 | Tobias | C10M 163/00<br>508/287 |
| 2012/0135898 | A1 | 5/2012 | Tipton et al. | |
| 2012/0289443 | A1 | 11/2012 | Tepper et al. | |
| 2015/0045263 | A1 | 2/2015 | Butke et al. | |
| 2015/0147012 | A1 | 5/2015 | Scancarello | |

OTHER PUBLICATIONS

International Search Report and Written Opinion for PCT/US2017/062309, dated Feb. 5, 2018 (14 pages).

* cited by examiner

THIADIAZOLE COMPONENTS, COMPOSITIONS, AND METHODS

BACKGROUND

Copper, bronze, brass, and alloys thereof, commonly referred to as "yellow metals" are used throughout multiple industries. For example, gears used in the automotive and mining industries typically include yellow metal components. Efficiently preventing or reducing the corrosion of yellow metal can be important.

Therefore, many additives have been devised that address corrosion, including yellow metal corrosion. Commercially available yellow metal corrosion inhibitors include thiadiazole-based products. The majority of the commercially available thiadiazole-based products, however, typically include a relatively high weight percentage, e.g., >80%, of a bis-alkyl-di-sulfanyl thiadiazole species. Typically, the relatively high weight percentage of the bis-alkyl-di-sulfanyl thiadiazole species is included in an attempt to increase the solubility of the yellow metal corrosion inhibitor in a diluent, such as a base oil.

These additives, however, typically lack efficiency and/or present one or more difficulties regarding the solubility of at least one component of the additives.

BRIEF SUMMARY

Provided herein are compositions comprising a thiadiazole component and a solubility enhancing component. In embodiments, the thiadiazole component comprises 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole; and the solubility enhancing component comprises a dispersant, a detergent, or a combination thereof. In one embodiment, the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1.

Also provided herein are methods of forming a thiadiazole component. In embodiments, the methods comprise providing a mixture comprising a $C_2$-$C_{30}$ hydrocarbyl thiol, 2,5-dimercapto-1,3,4-thiadiazole, and a polar liquid; and contacting the mixture with hydrogen peroxide to form the thiadiazole component, wherein the thiadiazole component comprises 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole at a weight ratio of about 20:80 to about 99.9:0.1 of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole. The polar liquid also may include tetrahydrofuran (THF), ethyl acetate, dimethylformamide (DMF), $C_1$-$C_{10}$ alcohol, water, or a combination thereof. In one embodiment, the molar ratio of the $C_2$-$C_{30}$ hydrocarbyl thiol to the 2,5-dimercapto-1,3,4-thiadiazole in the mixture is about 0.8:1 to about 2:1.

Also provided herein are methods of forming compositions. The methods of forming compositions, in embodiments, comprise providing a thiadiazole component comprising 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole at a weight ratio of about 20:80 to about 99.9:0.1 of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole; providing a solubility enhancing component comprising a dispersant, a detergent, or a combination thereof; and combining the thiadiazole component and the solubility enhancing component to form the composition.

Also provided herein are lubricating compositions and grease compositions. In embodiments, the lubricating compositions and grease compositions comprise a first composition comprising [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and [2] a solubility enhancing component consisting of a dispersant, a detergent, or the dispersant and the detergent; and a first base oil; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1, and the first composition is present in the lubricating composition or grease composition in an amount of about 0.01% to about 20% by weight of the lubricating composition or grease composition. In one embodiment, the first composition further comprises a second base oil. The first base oil and the second base oil may be or include the same base oil(s) or different base oils.

DETAILED DESCRIPTION

Provided herein are compositions, and methods for making compositions, that efficiently reduce or eliminate yellow metal corrosion, and substantially all of the contents of the compositions remain at least substantially soluble, for example, in a base oil. The compositions provided herein generally include a thiadiazole component and a solubility enhancing component. The thiadiazole component may include a minimum amount of 5-($C_2$-$C_{30}$ hydrocarbyl-disulfanyl)-1,3,4-thiadiazole-2-thiol, which is believed to improve the efficiency of the compositions provided herein. Although including at least a minimum amount of 5-($C_2$-$C_{30}$ hydrocarbyl-disulfanyl)-1,3,4-thiadiazole-2-thiol is believed to improve the efficiency of the compositions, higher weight percentages of the 5-($C_2$-$C_{30}$ hydrocarbyl-disulfanyl)-1,3,4-thiadiazole-2-thiol can present one or more difficulties regarding solubility, but these difficulties are at least partially addressed by the solubility enhancing component provided herein. The solubility enhancing component generally comprises a dispersant, a detergent, or a combination thereof.

In embodiments, the composition provided herein is a lubricant additive or a grease additive.

Thiadiazole Component

In one embodiment, the thiadiazole component comprises 5-($C_2$-$C_{30}$ hydrocarbyl-disulfanyl)-1,3,4-thiadiazole-2-thiol. In another embodiment, the thiadiazole component comprises 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole. The thiadiazole component also may include one or more of the additives described herein, including, but not limited to, a diluent, such as a base oil.

The 5-($C_2$-$C_{30}$ hydrocarbyl-disulfanyl)-1,3,4-thiadiazole-2-thiol may have the following generic structure:

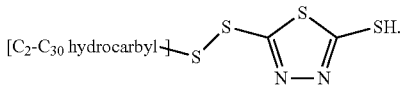

The 2,5-bis($C_2$-$C_{30}$ hydrocarbyl-disulfanyl)-1,3,4-thiadiazole may have the following generic structure:

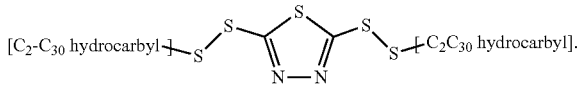

In one embodiment, the thiadiazole component consists essentially of 5-($C_2$-$C_{30}$ hydrocarbyl-disulfanyl)-1,3,4-thiadiazole-2-thiol. In another embodiment, the thiadiazole component consists essentially of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole. When used herein to describe the thiadiazole component, the phrases "consists essentially of" or "consisting essentially of" refer to thiadiazole components that include the recited elements, or the recited elements and one or more other materials that do not materially affect the basic and novel characteristics of the thiadiazole component, which may include [1] one or more additives, such as those described herein, for example, one or more diluents, such as a base oil, [2] one or more unreacted starting materials, such as $C_2$-$C_{30}$ hydrocarbyl thiols and 5-dimercapto-1,3,4-thiadiazole, [3] a polar liquid in which the thiadiazole component is formed, [4] hydrogen peroxide, and [5] any by-products of the reaction used to form the thiadiazole component. The by-products can include dimers and/or oligomers of [1] the starting materials and/or [2] products of the reaction used to form the thiadiazole component. Non-limiting examples of by-products include $C_2$-$C_{30}$ hydrocarbyl-$C_2$-$C_{30}$-hydrocarbyl disulfane and a compound of the following generic structure:

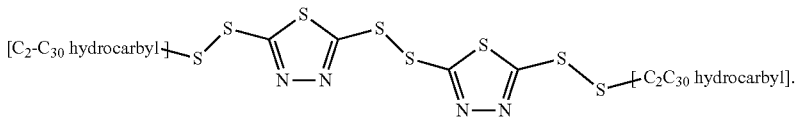

The weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole may be about 20:80 to about 100:0. As used herein, the phrase "weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole," and the like, refer to the theoretical weight ratio of the two species, as determined, for example, by the relative amounts of the starting materials used to form the species. In embodiments, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1. In a particular embodiment, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 95:5. In some embodiments, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 80:20. In particular embodiments, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 50:50 to about 99.9:0.1. In certain embodiments, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 60:40 to about 99.9:0.1. In one embodiment, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 60:40 to about 80:20.

The phrases "$C_2$-$C_{30}$ hydrocarbyl," "$C_8$-$C_{18}$ hydrocarbyl," "$C_2$-$C_4$ hydrocarbyl," and the like, as used herein, include an aliphatic group, a cyclic group, or any combination thereof; any substituted derivative thereof, including but not limited to any halide-, alkoxide-, or amide-substituted derivative thereof, that respectively has 2 to 30 carbon atoms, 8 to 18 carbon atoms, 2 to 4 carbon atoms, etc. Also included in the foregoing definitions are any unsubstituted, branched, or linear analogs thereof. The hydrocarbyls may be substituted with one or more functional moieties selected from a hydroxyl, a halide, an ether, a ketone, an ester, an amine, an amide, a nitrile, a heterocycle comprising at least one N-, O-, or S-heteroatom, an aldehyde, a thioether, an imine, a sulfone, a carbonate, a urethane, a urea, or an imide.

Examples of aliphatic groups, in each instance, include, but are not limited to, an alkyl group, a cycloalkyl group, an alkenyl group, a cycloalkenyl group, an alkynyl group, an alkadienyl group, a cyclic group, and the like, and includes all substituted, unsubstituted, branched, and linear analogs or derivatives thereof. Examples of alkyl groups include, but are not limited to, methyl, ethyl, propyl, isopropyl, n-butyl, t-butyl, isobutyl, pentyl, hexyl, isohexyl, heptyl, 4,4-dimethylpentyl, octyl, 2,2,4-trimethylpentyl, nonyl, t-nonyl, decyl, t-decyl, undecyl, t-undecyl, dodecyl, t-dodecyl, tridecyl, t-tridecyl, tetradecyl, t-tetradecyl, pentadecyl, t-pentadecyl, hexadecyl, t-hexadecyl, heptadecyl, t-heptadecyl, octadecyl, t-octadecyl, nonadecyl, t-nonadecyl, icosane, t-icosane, henicosane, t-henicosane, docosane, t-docosane, tricosane, t-tricosane, tetracosane, t-tetracosane, pentacosane, t-pentacosane, hexacosane, t-hexacosane, heptacosane, t-heptacosane, octacosane, t-octacosane, nonacosane, t-nonacosane, triacontane, t-triacontane, etc. Cycloalkyl moieties may be monocyclic or multicyclic, and examples include cyclopropyl, cyclobutyl, cyclopentyl, cyclohexyl, and adamantyl. Additional examples of alkyl moieties have linear, branched and/or cyclic portions (e.g., 1-ethyl-4-methyl-cyclohexyl). Representative alkenyl moieties include vinyl, allyl, 1-butenyl, 2-butenyl, isobutylenyl, 1-pentenyl, 2-pentenyl, 3-methyl-1-butenyl, 2-methyl-2-butenyl, 2,3-dimethyl-2-butenyl, 1-hexenyl, 2-hexenyl, 3-hexenyl, 1-heptenyl, 2-heptenyl, 3-heptenyl, 1-octenyl, 2-octenyl, 3-octenyl, 1-nonenyl, 2-nonenyl, 3-nonenyl, 1-decenyl, 2-decenyl and 3-decenyl. Representative alkynyl moieties include acetylenyl, propynyl, 1-butynyl, 2-butynyl, 1-pentynyl, 2-pentynyl, 3-methyl-1-butynyl, 4-pentynyl, 1-hexynyl, 2-hexynyl, 5-hexynyl, 1-heptynyl, 2-heptynyl, 6-heptynyl, 1-octynyl, 2-octynyl, 7-octynyl, 1-nonynyl, 2-nonynyl, 8-nonynyl, 1-decynyl, 2-decynyl and 9-decynyl.

As used herein, the term "monovalent" indicates that a species, such as a $C_2$-$C_{30}$ hydrocarbyl, is capable of forming one covalent bond with another atom. As used herein, the term "divalent" indicates that a species, such as a $C_2$-$C_{30}$ hydrocarbyl, is capable of forming two covalent bonds with two other atoms, or two covalent bonds with another atom, i.e., a double bond.

In one embodiment, the thiadiazole component comprises 5-($C_5$-$C_{25}$ hydrocarbyl-disulfanyl)-1,3,4-thiadiazole-2-thiol. In another embodiment, the thiadiazole component comprises 5-($C_5$-$C_{25}$ hydrocarbyl-disulfanyl)-1,3,4-thiadiazole-2-thiol and 2,5-bis($C_5$-$C_{25}$ hydrocarbyl-disulfanyl)-1,3,4-thiadiazole.

In one embodiment, the thiadiazole component consists of 5-($C_5$-$C_{25}$ hydrocarbyl-disulfanyl)-1,3,4-thiadiazole-2-thiol. In another embodiment, the thiadiazole component consists of 5-($C_5$-$C_{25}$ hydrocarbyl-disulfanyl)-1,3,4-thiadiazole-2-thiol and 2,5-bis($C_5$-$C_{25}$ hydrocarbyl-disulfanyl)-1,3,4-thiadiazole.

In one embodiment, the thiadiazole component consists essentially of 5-($C_5$-$C_{25}$ hydrocarbyl-disulfanyl)-1,3,4-thiadiazole-2-thiol. In another embodiment, the thiadiazole component consists essentially of 5-($C_5$-$C_{25}$ hydrocarbyl-disulfanyl)-1,3,4-thiadiazole-2-thiol and 2,5-bis($C_5$-$C_{25}$ hydrocarbyl-disulfanyl)-1,3,4-thiadiazole.

In one embodiment, the thiadiazole component comprises 5-($C_8$-$C_{18}$ hydrocarbyl-disulfanyl)-1,3,4-thiadiazole-2-thiol. In another embodiment, the thiadiazole component comprises 5-($C_8$-$C_{18}$ hydrocarbyl-disulfanyl)-1,3,4-thiadiazole-2-thiol and 2,5-bis($C_8$-$C_{18}$ hydrocarbyl-disulfanyl)-1,3,4-thiadiazole.

In one embodiment, the thiadiazole component consists of 5-($C_8$-$C_{18}$ hydrocarbyl-disulfanyl)-1,3,4-thiadiazole-2-thiol. In another embodiment, the thiadiazole component consists of 5-($C_8$-$C_{18}$ hydrocarbyl-disulfanyl)-1,3,4-thiadiazole-2-thiol and 2,5-bis($C_8$-$C_{18}$ hydrocarbyl-disulfanyl)-1,3,4-thiadiazole.

In one embodiment, the thiadiazole component consists essentially of 5-($C_8$-$C_{18}$ hydrocarbyl-disulfanyl)-1,3,4-thiadiazole-2-thiol. In another embodiment, the thiadiazole component consists essentially of 5-($C_8$-$C_{18}$ hydrocarbyl-disulfanyl)-1,3,4-thiadiazole-2-thiol and 2,5-bis($C_8$-$C_{18}$ hydrocarbyl-disulfanyl)-1,3,4-thiadiazole.

In one embodiment, the thiadiazole component comprises 5-($C_9$-$C_{12}$ hydrocarbyl-disulfanyl)-1,3,4-thiadiazole-2-thiol. In another embodiment, the thiadiazole component comprises 5-($C_9$-$C_{12}$ hydrocarbyl-disulfanyl)-1,3,4-thiadiazole-2-thiol and 2,5-bis($C_9$-$C_{12}$ hydrocarbyl-disulfanyl)-1,3,4-thiadiazole.

In one embodiment, the thiadiazole component consists of 5-($C_9$-$C_{12}$ hydrocarbyl-disulfanyl)-1,3,4-thiadiazole-2-thiol. In another embodiment, the thiadiazole component consists of 5-($C_9$-$C_{12}$ hydrocarbyl-disulfanyl)-1,3,4-thiadiazole-2-thiol and 2,5-bis($C_9$-$C_{12}$ hydrocarbyl-disulfanyl)-1,3,4-thiadiazole.

In one embodiment, the thiadiazole component consists essentially of 5-($C_9$-$C_{12}$ hydrocarbyl-disulfanyl)-1,3,4-thiadiazole-2-thiol. In another embodiment, the thiadiazole component consists essentially of 5-($C_9$-$C_{12}$ hydrocarbyl-disulfanyl)-1,3,4-thiadiazole-2-thiol and 2,5-bis($C_9$-$C_{12}$ hydrocarbyl-disulfanyl)-1,3,4-thiadiazole.

In one embodiment, the thiadiazole component comprises 5-(t-nonyldisulfanyl)-1,3,4-thiadiazole-2-thiol. In another embodiment, the thiadiazole component comprises 5-(t-nonyldisulfanyl)-1,3,4-thiadiazole-2-thiol and 2,5-bis(t-nonyldisulfanyl)-1,3,4-thiadiazole. In a particular embodiment, the thiadiazole component comprises 5-(t-nonyldisulfanyl)-1,3,4-thiadiazole-2-thiol and 2,5-bis(t-nonyldisulfanyl)-1,3,4-thiadiazole, and the weight ratio of the 5-(t-nonyldisulfanyl)-1,3,4-thiadiazole-2-thiol to the 2,5-bis(t-nonyldisulfanyl)-1,3,4-thiadiazole in the thiadiazole component is about 20:80 to about 99.9:0.1; about 20:80 to about 80:20; about 50:50 to about 99.9:0.1; about 60:40 to about 99.9:0.1; or about 60:40 to about 80:20. In a further embodiment, the thiadiazole component consists of 5-(t-nonyldisulfanyl)-1,3,4-thiadiazole-2-thiol and 2,5-bis(t-nonyldisulfanyl)-1,3,4-thiadiazole, and the weight ratio of the 5-(t-nonyldisulfanyl)-1,3,4-thiadiazole-2-thiol to the 2,5-bis(t-nonyldisulfanyl)-1,3,4-thiadiazole in the thiadiazole component is about 20:80 to about 99.9:0.1; about 20:80 to about 80:20; about 50:50 to about 99.9:0.1; about 60:40 to about 99.9:0.1; or about 60:40 to about 80:20. In a still further embodiment, the thiadiazole component consists essentially of 5-(t-nonyldisulfanyl)-1,3,4-thiadiazole-2-thiol and 2,5-bis(t-nonyldisulfanyl)-1,3,4-thiadiazole, and the weight ratio of the 5-(t-nonyldisulfanyl)-1,3,4-thiadiazole-2-thiol to the 2,5-bis(t-nonyldisulfanyl)-1,3,4-thiadiazole in the thiadiazole component is about 20:80 to about 99.9:0.1; about 20:80 to about 80:20; about 50:50 to about 99.9:0.1; about 60:40 to about 99.9:0.1; or about 60:40 to about 80:20.

In one embodiment, the thiadiazole component comprises 5-(t-dodecyldisulfanyl)-1,3,4-thiadiazole-2-thiol. In another embodiment, the thiadiazole component comprises 5-(t-dodecyldisulfanyl)-1,3,4-thiadiazole-2-thiol and 2,5-bis(t-dodecyldisulfanyl)-1,3,4-thiadiazole. In a particular embodiment, the thiadiazole component comprises 5-(t-dodecyldisulfanyl)-1,3,4-thiadiazole-2-thiol and 2,5-bis(t-dodecyldisulfanyl)-1,3,4-thiadiazole, and the weight ratio of the 5-(t-dodecyldisulfanyl)-1,3,4-thiadiazole-2-thiol to the 2,5-bis(t-dodecyldisulfanyl)-1,3,4-thiadiazole in the thiadiazole component is about 20:80 to about 99.9:0.1; about 20:80 to about 80:20; about 50:50 to about 99.9:0.1; about 60:40 to about 99.9:0.1; or about 60:40 to about 80:20. In a further embodiment, the thiadiazole component consists of 5-(t-dodecyldisulfanyl)-1,3,4-thiadiazole-2-thiol and 2,5-bis(t-dodecyldisulfanyl)-1,3,4-thiadiazole, and the weight ratio of the 5-(t-dodecyldisulfanyl)-1,3,4-thiadiazole-2-thiol to the 2,5-bis(t-dodecyldisulfanyl)-1,3,4-thiadiazole in the thiadiazole component is about 20:80 to about 99.9:0.1; about 20:80 to about 80:20; about 50:50 to about 99.9:0.1; about 60:40 to about 99.9:0.1; or about 60:40 to about 80:20. In a still further embodiment, the thiadiazole component consists essentially of 5-(t-dodecyldisulfanyl)-1,3,4-thiadiazole-2-thiol and 2,5-bis(t-dodecyldisulfanyl)-1,3,4-thiadiazole, and the weight ratio of the 5-(t-dodecyldisulfanyl)-1,3,4-thiadiazole-2-thiol to the 2,5-bis(t-dodecyldisulfanyl)-1,3,4-thiadiazole in the thiadiazole component is about 20:80 to about 99.9:0.1; about 20:80 to about 80:20; about 50:50 to about 99.9:0.1; about 60:40 to about 99.9:0.1; or about 60:40 to about 80:20.

Solubility Enhancing Component

The solubility enhancing component may comprise a dispersant, a detergent, or a combination thereof. The dispersant, the detergent, or both the dispersant and the detergent may be combined with one or more of the additives provided herein prior to being combined with the thiadiazole component. For example, the solubility enhancing component may consist of the detergent, and the detergent may be combined with a liquid, such as a base oil or other diluent, prior to combining the detergent with the thiadiazole component.

As used herein, the term "dispersant" generally refers to a metal-free compound having at least one polar moiety or functional group, and at least one non-polar moiety or functional group. As used herein, the term "detergent" generally refers to a metal ion-containing compound having at least one polar moiety or functional group, and at least one non-polar moiety or functional group. The at least one polar moiety or functional group may include any of those known in the art, such as a carbonyl, an amide, a succinimide, a hydroxyl, a phenate, a substituted aryl, an amine, or any combination thereof. The at least one non-polar moiety may include a $C_2$-$C_{30}$ hydrocarbyl or a hydrocarbyl having a molecular weight of about 500 to about 2500 as provided herein.

In one embodiment, the solubility enhancing component consists of the detergent. In another embodiment, the solubility enhancing component consists of the dispersant. In a further embodiment, the solubility enhancing component consists of the detergent and the dispersant.

In one embodiment, the solubility enhancing component consists essentially of the detergent. In another embodiment, the solubility enhancing component consists essentially of the dispersant. In a further embodiment, the solubility enhancing component consists essentially of the dispersant and the detergent. When used herein to describe the solubility enhancing component, the phrases "consists essentially of" or "consisting essentially of" refer to solubility enhancing components that include the recited elements, or the recited elements and one or more other materials that do not materially affect the basic and novel characteristics of the solubility enhancing component, which may include one or more additives, such as those described herein, for example, one or more diluents, such as a base oil, one or more unreacted starting materials, and one or more by-products of the reaction used to make the detergent and/or dispersant.

In one embodiment, the thiadiazole component consists essentially of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and the solubility enhancing component consists essentially of a dispersant.

In one embodiment, the thiadiazole component consists essentially of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and the solubility enhancing component consists essentially of a detergent.

In one embodiment, the thiadiazole component consists essentially of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and the solubility enhancing component consists essentially of a dispersant and a detergent.

In one embodiment, the thiadiazole component consists of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and the solubility enhancing component consists of a dispersant.

In one embodiment, the thiadiazole component consists of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and the solubility enhancing component consists of a detergent.

In one embodiment, the thiadiazole component consists of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and the solubility enhancing component consists of a dispersant and a detergent.

In embodiments, the weight ratio of the solubility enhancing component to the thiadiazole component is about 1:99 to about 90:10. In one embodiment, the weight ratio of the solubility enhancing component to the thiadiazole component is about 1:99 to about 75:25. In another embodiment, the weight ratio of the solubility enhancing component to the thiadiazole component is about 1:99 to about 50:50. In yet another embodiment, the weight ratio of the solubility enhancing component to the thiadiazole component is about 1:99 to about 25:75. In a further embodiment, the weight ratio of the solubility enhancing component to the thiadiazole component is about 1:99 to about 10:90. In a still further embodiment, the weight ratio of the solubility enhancing component to the thiadiazole component is about 2:98 to about 6:94. In a particular embodiment, the weight ratio of the solubility enhancing component to the thiadiazole component is about 2:98. In a certain embodiment, the weight ratio of the solubility enhancing component to the thiadiazole component is about 4:96. In another certain embodiment, the weight ratio of the solubility enhancing component to the thiadiazole component is about 10:90.

When the solubility enhancing component comprises a detergent and a dispersant, the detergent and the dispersant generally may be present at any weight ratio. For example, the detergent and the dispersant may be present in the solubility enhancing component at a weight ratio of about 0.1:99.9 to about 99.9:0.1 of detergent to dispersant. In one embodiment, the detergent and the dispersant are present in the solubility enhancing additive at a weight ratio of detergent to dispersant of about 30:70 to about 70:30, from about 30:70 to about 60:40, from about 40:60 to about 60:40, about 45:55 to about 55:45, about 50:50, or about 45:55.

Dispersants

The dispersant may comprise a succinimide functional group. The dispersant may include one succinimide functional group, or more than one succinimide functional group. For example, the dispersant may include two succinimide functional groups. The phrase "succinimide functional group," as used herein, refers to a pyrrolidine-2,5-dione, which may be substituted at the 1-position, 3-position, 4-position, or any combination thereof. The substituents may independently include a $C_2$-$C_{30}$ hydrocarbyl as provided herein. The substituents also may independently include a hydrocarbyl having a molecular weight of about 500 to about 2500. The dispersant comprising a succinimide functional group also may be borated. The borated dispersant comprising a succinimide functional group may include boron in an amount of about 0.01% to about 5.0%, by weight of the borated dispersant. The dispersant may be borated by contacting the dispersant with a boron-containing compound, such as boric acid, boron oxide, or a combination thereof. In one embodiment, the dispersant comprising the succinimide functional group is a borated dispersant, and boron is present in the borated dispersant in an amount of about 0.01% to about 5.0% by weight of the borated dispersant.

The phrases "a hydrocarbyl having a molecular weight of about 500 to about 2500," "about 30 to about 3000," "about 100 to about 500," or the like, as used herein, refer to an aliphatic group, a cyclic group, or any combination thereof; any substituted derivative thereof, including but not limited to any halide-, alkoxide-, or amide-substituted derivative thereof, that respectively has a molecular weight or an average molecular weight of about 500 g/mol to about 2500 g/mol, about 30 g/mol to about 3000 g/mol, about 100 g/mol to about 500 g/mol, etc., respectively. The phrase "average molecular weight" refers to the number average molecular weight of the hydrocarbyl, unless otherwise noted. Also included in the foregoing definition are any unsubstituted, branched, or linear analogs thereof. The hydrocarbyls include substituted derivatives therein, including hydrocarbyls substituted with one or more functional moieties selected from a hydroxyl, a halide, an ether, a ketone, an ester, an amine, an amide, a nitrile, a heterocycle comprising at least one N-, O-, or S-heteroatom, an aldehyde, a thioether, an imine, a sulfone, a carbonate, a urethane, a urea, or an imide.

In embodiments, the dispersant comprises a succinimide functional group, and is a 1-(amino-$C_2$-$C_4$ hydrocarbyl)-3-hydrocarbylpyrrolidine-2,5-dione having the following structure:

(D1)

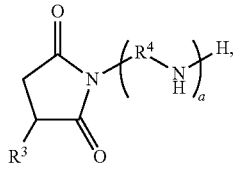

wherein $R^3$ is a monovalent hydrocarbyl having a molecular weight of about 500 to about 2500, $R^4$ is a divalent $C_2$-$C_4$ hydrocarbyl, and a is 1 to 100. In one embodiment, $R_4$ is a divalent $C_2$ hydrocarbyl. In another embodiment, a is 1 to 10. In a further embodiment, $R_4$ is a divalent $C_2$ hydrocarbyl, and a is 1 to 10.

In embodiments, the dispersant comprises a succinimide functional group, and comprises a mixture of 1-(amino-$C_2$-$C_4$ hydrocarbyl)-3-hydrocarbylpyrrolidine-2,5-diones having the following structures:

(D1A)

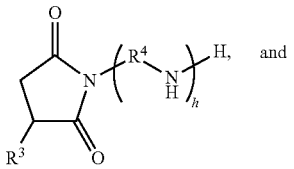

(D1B)

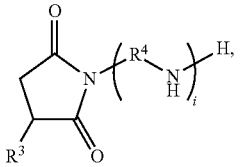

wherein each $R^3$ is independently a monovalent hydrocarbyl having a molecular weight of about 500 to about 2500, each $R^4$ is independently a divalent $C_2$-$C_4$ hydrocarbyl, h is 1 to 100, and i is 1 to 100. In one embodiment, each $R_4$ is a divalent $C_2$ hydrocarbyl. In another embodiment, h is 1 to 10, and i is 1 to 10. In a further embodiment, each $R_4$ is a divalent $C_2$ hydrocarbyl, h is 1 to 10, and i is 1 to 10.

In embodiments, the dispersant comprises a succinimide functional group, and is a 3-hydrocarbyl-1-(((2-(3-hydrocarbyl-2,5-dioxopyrrolidin-1-yl)hydrocarbyl)amino)hydrocarbyl) pyrrolidine-2,5-dione having the following structure:

(D2)

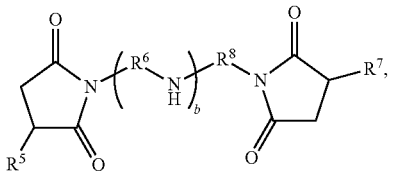

wherein $R^5$ is a monovalent hydrocarbyl having a molecular weight of about 500 to about 2500, $R^6$ is a divalent $C_2$-$C_4$ hydrocarbyl, $R^7$ is a monovalent hydrocarbyl having a molecular weight of about 500 to about 2500, $R^8$ is a divalent $C_2$-$C_4$ hydrocarbyl, and b is from 1 to 100. In one embodiment, $R_6$ is a divalent $C_2$ hydrocarbyl. In another embodiment, b is 1 to 10. In a further embodiment, $R_6$ is a divalent $C_2$ hydrocarbyl, and b is 1 to 10. $R_6$ and $R_8$ may be identical or different. $R_5$ and $R_7$ may be identical or different.

In embodiments, the dispersant comprises a succinimide functional group, and comprises a mixture of 3-hydrocarbyl-1-(((2-(3-hydrocarbyl-2,5-dioxopyrrolidin-1-yl)hydrocarbyl)amino)hydrocarbyl) pyrrolidine-2,5-diones having the following structures:

(D2A)

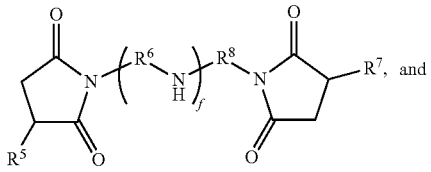

(D2B)

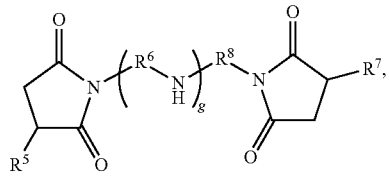

wherein each $R^5$ independently is a monovalent hydrocarbyl having a molecular weight of about 500 to about 2500, each $R^6$ is independently a divalent $C_2$-$C_4$ hydrocarbyl, each $R^7$ is independently a monovalent hydrocarbyl having a molecular weight of about 500 to about 2500, each $R^8$ is independently a divalent $C_2$-$C_4$ hydrocarbyl, f is 1 to 100, g is 1 to 100, and f and g are different. In one embodiment, each $R_6$ is a divalent $C_2$ hydrocarbyl. In another embodiment, f is 1 to 10 and g is 1 to 10. In a further embodiment, each $R_6$ is a divalent $C_2$ hydrocarbyl, f is 1 to 10, and g is 1 to 10. Each $R_6$ and $R_8$ may be identical or different. Each $R_5$ and $R_7$ may be identical or different.

In one embodiment, the dispersant is a combination of at least one compound of formula D1 and at least one compound of formula D2.

The dispersant may be a Mannich dispersant. As used herein, the phrase "Mannich dispersant" refers to dispersants that comprise the reaction product of an amine, an aldehyde, and a hydrocarbyl-phenol. The Mannich dispersant also may be borated. The borated Mannich dispersant may include boron in an amount of about 0.01% to about 5.0%, by weight of the borated dispersant. The Mannich dispersant may be borated by contacting the Mannich dispersant with a boron-containing compound, such as boric acid, boron oxide, or a combination thereof. In one embodiment, the Mannich dispersant is a borated dispersant, and boron is present in the borated dispersant in an amount of about 0.01% to about 5.0% by weight of the borated dispersant.

In one embodiment, the dispersant is a Mannich dispersant having the following structure:

(D3)

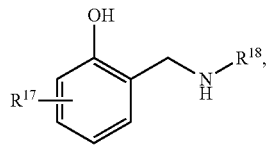

wherein $R^{17}$ is a monovalent hydrocarbyl having a molecular weight of about 500 to about 2500, and $R^{18}$ is a monovalent $C_1$-$C_{100}$ hydrocarbyl. In a particular embodiment, $R^{18}$ is a monovalent $C_1$-$C_{10}$ hydrocarbyl. In a further embodiment, $R^{18}$ is substituted with one or more polar substituents. The polar substituents may include at least one hydroxyl group, at least one amino group, or a combination thereof. In a still further embodiment, $R^{18}$ is a monovalent $C_1$-$C_{10}$ hydrocarbyl that is substituted with one or more polar substituents, such as at least one hydroxyl, at least one amine, or a combination thereof.

In one embodiment, the dispersant is a combination of at least one compound of formula D1 and at least one compound of formula D3. In another embodiment, the dispersant is a combination of at least one compound of formula D2 and at least one compound of formula D3. In yet another embodiment, the dispersant is a combination of at least one compound of formula D1, at least one compound of formula D2, and at least one compound of formula D3.

In one embodiment, the dispersant is a Mannich dispersant having the structure of D3, wherein $R^{17}$ is substituted at the 4-position:

(D3A)

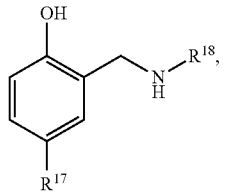

wherein $R_{17}$ is a monovalent hydrocarbyl having a molecular weight of about 500 to about 2500, and $R_{18}$ is a monovalent $C_1$-$C_{100}$ hydrocarbyl. In a particular embodiment, $R^{18}$ is a monovalent $C_1$-$C_{10}$ hydrocarbyl. In a further embodiment, $R^{18}$ is substituted with one or more polar substituents. The polar substituents may include at least one hydroxyl group, at least one amino group, or a combination thereof. In a still further embodiment, $R^{18}$ is a monovalent $C_1$-$C_{10}$ hydrocarbyl that is substituted with one or more polar substituents, such as at least one hydroxyl, at least amine, or a combination thereof.

In one embodiment, the dispersant is a Mannich dispersant having the following structure:

(D4)

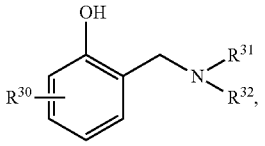

wherein $R^{30}$ is a monovalent hydrocarbyl having a molecular weight of about 500 to about 2500, and $R^{31}$ and $R^{32}$ are independently selected from hydrogen or a monovalent $C_1$-$C_{100}$ hydrocarbyl. The $C_1$-$C_{100}$ hydrocarbyl of each of $R_{31}$ and/or $R_{32}$ may be substituted with one or more nitrogen atoms. The Mannich dispersants provided herein may be prepared by methods known in the art, including those provided at U.S. Pat. Nos. 3,036,003 and 3,697,574.

In one embodiment, the dispersant is a combination of [1] at least one compound of formula D1, at least one compound of formula D2, or at least one compound of formula D3, and [2] at least one compound of formula D4. In another embodiment, the dispersant is a combination of at least one compound of formula D1, at least one compound of formula D2, and at least one compound of formula D4. In a further embodiment, the dispersant is a combination of at least one compound of formula D1, at least one compound of formula D3, and at least one compound of formula D4. In a particular embodiment, the dispersant is a combination of at least one compound of formula D2, at least one compound of formula D3, and at least one compound of formula D4. In yet another embodiment, the dispersant is a combination of at least one compound of formula D1, at least one compound of formula D2, at least one compound of formula D3, and at least one compound of formula D4.

In one embodiment, the dispersant is a Mannich dispersant having the following structure:

(D5)

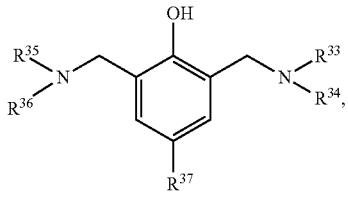

wherein $R^{33\text{-}36}$ are independently selected from hydrogen or a monovalent $C_1$-$C_{100}$ hydrocarbyl, and $R^{37}$ is a monovalent hydrocarbyl having a molecular weight of about 500 to about 2500. The $C_1$-$C_{100}$ hydrocarbyl of each of $R^{33\text{-}36}$ may be substituted with one or more nitrogen atoms.

In one embodiment, the dispersant is a combination of [1] at least one compound of formula D1, at least one compound of formula D2, at least one compound of formula D3, or at least one compound of formula D4, and [2] at least one compound of formula D5. In another embodiment, the dispersant is a combination of at least one compound of formula D1, at least one compound of formula D2, and at least one compound of formula D5. In a further embodiment, the dispersant is a combination of at least one compound of formula D1, at least one compound of formula D3, and at least one compound of formula D5. In a particular embodiment, the dispersant is a combination of at least one compound of formula D1, at least one compound of formula D4, and at least one compound of formula D5. In embodiments, the dispersant is a combination of at least one compound of formula D2, at least one compound of formula D3, and at least one compound of formula D5. In some embodiments, the dispersant is a combination of at least one compound of formula D2, at least one compound of formula D4, and at least one compound of formula D5. In further embodiments, the dispersant is a combination of at least one compound of formula D3, at least one compound of formula D4, and at least one compound of formula D5. In a certain embodiment, the dispersant is a combination of [1] three of the following: at least one compound of formula D1, at least one compound of formula D2, at least one compound of formula D3, and at least one compound of formula D4, and [2] at least one compound of formula D5. In yet another embodiment, the dispersant is a combination of at least one compound of formula D1, at least one compound of formula D2, at least one compound of formula D3, at least one compound of formula D4, and at least one compound of formula D5.

In one embodiment, the dispersant is a Mannich dispersant having the following structure:

(D6)

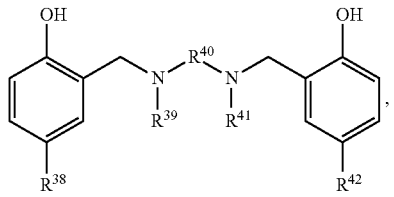

wherein $R^{38}$ and $R^{42}$ are independently selected from a monovalent hydrocarbyl having a molecular weight of about 500 to about 2500, $R^{39}$ and $R^{41}$ are independently selected from hydrogen or a monovalent $C_1$-$C_{100}$ hydrocarbyl, and $R^{40}$ is a divalent $C_1$-$C_{100}$ hydrocarbyl. The $C_1$-$C_{100}$ hydrocarbyls of $R^{39}$, $R^{40}$, and $R^{41}$ may independently include one or more nitrogen atoms.

In one embodiment, the dispersant is a combination of [1] at least one compound of formula D1, at least one compound of formula D2, at least one compound of formula D3, at least one compound of formula D4, or at least one compound of formula D5, and [2] at least one compound of formula D6. In another embodiment, the dispersant is a combination of at least one compound of formula D1, at least one compound of formula D2, and at least one compound of formula D6. In a further embodiment, the dispersant is a combination of at least one compound of formula D1, at least one compound of formula D3, and at least one compound of formula D6. In a particular embodiment, the dispersant is a combination of at least one compound of formula D1, at least one compound of formula D4, and at least one compound of formula D6. In an additional particular embodiment, the dispersant is a combination of at least one compound of formula D1, at least one compound of formula D5, and at least one compound of formula D6. In embodiments, the dispersant is a combination of at least one compound of formula D2, at least one compound of formula D3, and at least one compound of formula D6. In some embodiments, the dispersant is a combination of at least one compound of formula D2, at least one compound of formula D4, and at least one compound of formula D6. In certain particular embodiments, the dispersant is a combination of at least one compound of formula D2, at least one compound of formula D5, and at least one compound of formula D6. In further embodiments, the dispersant is a combination of at least one compound of formula D3, at least one compound of formula D4, and at least one compound of formula D6. In still further embodiments, the dispersant is a combination of at least one compound of formula D3, at least one compound of formula D5, and at least one compound of formula D6. In additional embodiments, the dispersant is a combination of at least one compound of formula D4, at least one compound of formula D5, and at least one compound of formula D6. In a certain embodiment, the dispersant is a combination of [1] three of the following: at least one compound of formula D1, at least one compound of formula D2, at least one compound of formula D3, at least one compound of formula D4, and at least one compound of formula D5, and [2] at least one compound of formula D6. In a particular embodiment, the dispersant is a combination of [1] four of the following: at least one compound of formula D1, at least one compound of formula D2, at least one compound of formula D3, at least one compound of formula D4, and at least one compound of formula D5, and [2] at least one compound of formula D6. In yet another embodiment, the dispersant is a combination of at least one compound of formula D1, at least one compound of formula D2, at least one compound of formula D3, at least one compound of formula D4, at least one compound of formula D5, and at least one compound of formula D6.

In one embodiment, the dispersant is a Mannich dispersant having the following structure:

(D7)

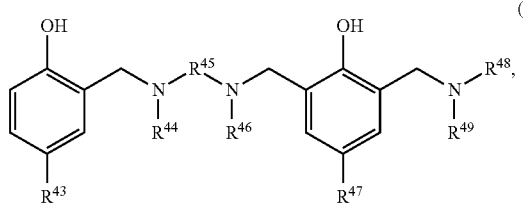

wherein $R^{43}$ and $R^{47}$ are independently selected from a monovalent hydrocarbyl having a molecular weight of about 500 to about 2500, $R^{44}$, $R^{46}$, $R^{48}$, and $R^{49}$ are independently selected from hydrogen or a monovalent $C_1$-$C_{100}$ hydrocarbyl, and $R^{45}$ is a divalent $C_1$-$C_{100}$ hydrocarbyl. The $C_1$-$C_{100}$ hydrocarbyls of $R^{44}$, $R^{45}$, $R^{46}$, $R^{48}$, and $R^{49}$ may independently include one or more nitrogen atoms.

In one embodiment, the dispersant is a combination of [1] at least one compound of formula D1, at least one compound of formula D2, at least one compound of formula D3, at least one compound of formula D4, at least one compound of formula D5, or at least one compound of formula D6, and [2] at least one compound of formula D7. In another embodiment, the dispersant is a combination of [1] at least two of at least one compound of formula D1, at least one compound of formula D2, at least one compound of formula D3, at least one compound of formula D4, at least one compound of formula D5, and at least one compound of formula D6, and [2] at least one compound of formula D7. In a further embodiment, the dispersant is a combination of [1] at least three of at least one compound of formula D1, at least one compound of formula D2, at least one compound of formula D3, at least one compound of formula D4, at least one compound of formula D5, and at least one compound of formula D6, and [2] at least one compound of formula D7. In yet another embodiment, the dispersant is a combination of [1] at least four of at least one compound of formula D1, at least one compound of formula D2, at least one compound of formula D3, at least one compound of formula D4, at least one compound of formula D5, and at least one compound of formula D6, and [2] at least one compound of formula D7. In a still further embodiment, the dispersant is a combination of [1] at least five of at least one compound of formula D1, at least one compound of formula D2, at least one compound of formula D3, at least one compound of formula D4, at least one compound of formula D5, and at least one compound of formula D6, and [2] at least one compound of formula D7. In an additional embodiment, the dispersant is a combination of at least one compound of formula D1, at least one compound of formula D2, at least one compound of formula D3, at least one compound of formula D4, at least one compound of formula D5, at least one compound of formula D6, and at least one compound of formula D7.

In one embodiment, the dispersant is a Mannich dispersant having the following structure:

(D8)

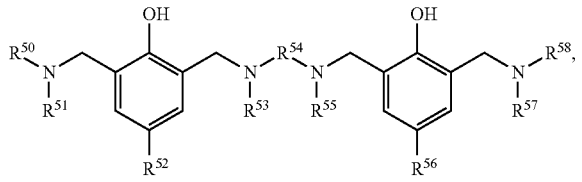

wherein $R^{52}$ and $R^{56}$ are independently selected from a monovalent hydrocarbyl having a molecular weight of about 500 to about 2500, $R^{50}$, $R^{51}$, $R^{53}$, $R^{55}$, $R^{57}$ and $R^{58}$ are independently selected from hydrogen or a monovalent $C_1$-$C_{100}$ hydrocarbyl, and $R^{54}$ is a divalent $C_1$-$C_{100}$ hydrocarbyl. The $C_1$-$C_{100}$ hydrocarbyls of $R^{50}$, $R^{51}$, $R^{53}$, $R^{54}$, $R^{55}$, $R^{57}$ and $R^{58}$ may independently include one or more nitrogen atoms.

In one embodiment, the dispersant is a combination of [1] at least one compound of formula D1, at least one compound of formula D2, at least one compound of formula D3, at least one compound of formula D4, at least one compound of formula D5, at least one compound of formula D6, or at least one compound of formula D7, and [2] at least one compound of formula D8. In another embodiment, the dispersant is a combination of [1] at least two of at least one compound of formula D1, at least one compound of formula D2, at least one compound of formula D3, at least one compound of formula D4, at least one compound of formula D5, at least one compound of formula D6, and at least one compound of formula D7, and [2] at least one compound of formula D8. In a further embodiment, the dispersant is a combination of [1] at least three of at least one compound of formula D1, at least one compound of formula D2, at least one compound of formula D3, at least one compound of formula D4, at least one compound of formula D5, at least one compound of formula D6, and at least one compound of formula D7, and [2] at least one compound of formula D8. In yet another embodiment, the dispersant is a combination of [1] at least four of at least one compound of formula D1, at least one compound of formula D2, at least one compound of formula D3, at least one compound of formula D4, at least one compound of formula D5, at least one compound of formula D6, and at least one compound of formula D7, and [2] at least one compound of formula D8. In a still further embodiment, the dispersant is a combination of [1] at least five of at least one compound of formula D1, at least one compound of formula D2, at least one compound of formula D3, at least one compound of formula D4, at least one compound of formula D5, at least one compound of formula D6, and at least one compound of formula D7, and [2] at least one compound of formula D8. In a particular embodiment, the dispersant is a combination of [1] at least six of at least one compound of formula D1, at least one compound of formula D2, at least one compound of formula D3, at least one compound of formula D4, at least one compound of formula D5, at least one compound of formula D6, and at least one compound of formula D7, and [2] at least one compound of formula D8. In an additional embodiment, the dispersant is a combination of at least one compound of formula D1, at least one compound of formula D2, at least one compound of formula D3, at least one compound of formula D4, at least one compound of formula D5, at least one compound of formula D6, at least one compound of formula D7, and at least one compound of formula D8.

The dispersant may be a succinic acid di-ester dispersant. As used herein, the phrase "succinic acid di-ester dispersant" refers to dispersants that include in their structures a di-ester of succinic acid. The di-ester of succinic acid may be substituted at one or both of the carbon atoms of the ethylene moiety that connects the two carbonyl groups of the esters. Examples of succinic acid di-ester compounds appear at U.S. Pat. No. 4,234,435, which is incorporated by reference, and discloses succinic acid di-ester compounds that are the reaction product of a substituted succinic anhydride and one or more alcohols, such as a polyhydric alcohol, e.g., pentaerythritol.

In one embodiment, the dispersant comprises a succinic acid di-ester dispersant having the following structure:

(D9)

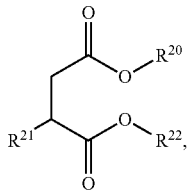

wherein $R^{20}$ and $R^{22}$ are independently selected from a monovalent hydrocarbyl having a molecular weight of about 60 to about 3000, and $R^{21}$ is selected from a monovalent hydrocarbyl having a molecular weight of about 500 to about 2500. At least one of $R^{20}$ and $R^{22}$ may be substituted with one or more polar groups, such as one or more hydroxyl groups, one or more amino groups, or a combination thereof.

In one embodiment, the dispersant is a combination of [1] at least one compound of formula D1, at least one compound of formula D2, at least one compound of formula D3, at least one compound of formula D4, at least one compound of formula D5, at least one compound of formula D6, at least one compound of formula D7, or at least one compound of formula D8, and [2] at least one compound of formula D9. In another embodiment, the dispersant is a combination of [1] at least two of at least one compound of formula D1, at least one compound of formula D2, at least one compound of formula D3, at least one compound of formula D4, at least one compound of formula D5, at least one compound of formula D6, at least one compound of formula D7, and at least one compound of formula D8, and [2] at least one compound of formula D9. In a further embodiment, the dispersant is a combination of [1] at least three of at least one compound of formula D1, at least one compound of formula D2, at least one compound of formula D3, at least one compound of formula D4, at least one compound of formula D5, at least one compound of formula D6, at least one compound of formula D7, and at least one compound of formula D8, and [2] at least one compound of formula D9. In yet another embodiment, the dispersant is a combination of [1] at least four of at least one compound of formula D1, at least one compound of formula D2, at least one compound of formula D3, at least one compound of formula D4, at least one compound of formula D5, at least one compound of formula D6, at least one compound of formula D7, and at least one compound of formula D8, and [2] at least one compound of formula D9. In a still further embodiment, the dispersant is a combination of [1] at least five of at least one compound of formula D1, at least one compound of formula D2, at least one compound of formula D3, at least one compound of formula D4, at least one compound of formula D5, at least one compound of formula D6, at least one compound of formula D7, and at least one compound of formula D8, and [2] at least one compound of formula D9. In a particular embodiment, the dispersant is a combination of [1] at least six of at least one compound of formula D1, at least one compound of formula D2, at least one compound of formula D3, at least one compound of formula D4, at least one compound of formula D5, at least one compound of formula D6, at least one compound of formula D7, and at least one compound of formula D8, and [2] at least one compound of formula D9. In another particular embodiment, the dispersant is a combination of [1] at least seven of at least one compound of formula D1, at least one compound of formula D2, at least one compound of formula D3, at least one compound of formula D4, at least one compound of formula D5, at least one compound of formula D6, at least one compound of formula D7, and at least one compound of formula D8, and [2] at least one compound of formula D9. In an additional embodiment, the dispersant is a combination of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9.

In one embodiment, the dispersant comprises a succinic acid di-ester dispersant having the following structure:

(D10)

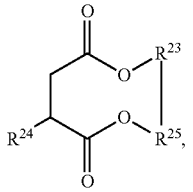

wherein $R^{23}$ and $R^{25}$ are independently selected from a divalent hydrocarbyl having a molecular weight of about 60 to about 3000, and $R^{24}$ is selected from a monovalent hydrocarbyl having a molecular weight of about 500 to about 2500. Generally, any carbon atom or substituent of $R^{23}$ may be covalently bonded to any carbon atom or substituent of $R^{25}$. At least one of $R^{23}$ and $R^{25}$ may be substituted with one or more polar groups, such as one or more hydroxyl groups, one or more amino groups, or a combination thereof.

In one embodiment, the dispersant is a combination of [1] at least one compound of formula D1, at least one compound of formula D2, at least one compound of formula D3, at least one compound of formula D4, at least one compound of formula D5, at least one compound of formula D6, at least one compound of formula D7, at least one compound of formula D8, or at least one compound of formula D9, and [2] at least one compound of formula D10. In another embodiment, the dispersant is a combination of [1] at least two of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In a further embodiment, the dispersant is a combination of [1] at least three of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In yet another embodiment, the dispersant is a combination of [1] at least four of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In a still further embodiment, the dispersant is a combination of [1] at least five of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In a particular embodiment, the dispersant is a combination of [1] at least six of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In another particular embodiment, the dispersant is a combination of [1] at least seven of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In yet another particular embodiment, the dispersant is a combination of [1] at least eight of at least one compound of formula D1, at least one compound of formula D2, at least one compound of formula D3, at least one compound of formula D4, at least one compound of formula D5, at least one compound of formula D6, at least one compound of formula D7, at least one compound of formula D8, and at least one compound of formula D9, and [2] at least one compound of formula D10. In an additional embodiment, the dispersant is a combination of at least one compound of formula D1, at least one compound of formula D2, at least one compound of formula D3, at least one compound of formula D4, at least one compound of formula D5, at least one compound of formula D6, at least one compound of formula D7, at least one compound of formula D8, at least one compound of formula D9, and at least one compound of formula D10.

In embodiments, the dispersant comprises a dispersant comprising a succinimide functional group, a Mannich dispersant, a succinic acid di-ester dispersant, or a combination thereof. In one embodiment, the dispersant comprises a dispersant comprising a succinimide functional group and a Mannich dispersant. In another embodiment, the dispersant comprises a dispersant comprising a succinimide functional group and a succinic acid di-ester dispersant. In a particular embodiment, the dispersant comprises a Mannich dispersant and a succinic acid di-ester dispersant.

Detergent

In embodiments, the detergent comprises a salt of a sulfonic acid. The sulfonic acid, in one embodiment, is a benzene sulfonic acid. The benzene sulfonic acid may comprise a $C_1$-$C_{30}$ hydrocarbyl-substituted benzenesulfonic acid, a di-$C_1$-$C_{30}$ hydrocarbyl-substituted benzenesulfonic acid, a tri-$C_1$-$C_{30}$ hydrocarbyl-substituted benzenesulfonic acid, or a combination thereof. The $C_1$-$C_{30}$ hydrocarbyl substituents may be present at the ortho position, the meta position, the para position, or a combination thereof. When the benzene sulfonic acid comprises a di-$C_1$-$C_{30}$ hydrocarbyl-substituted or a tri-$C_1$-$C_{30}$ hydrocarbyl-substituted benzenesulfonic acid, the total number of carbon atoms in all of the hydrocarbyl substituents may be from 10 to 50, from 10 to 40, from 16 to 30, from 16 to 25, or from 20 to 24. Any two of the $C_1$-$C_{30}$ hydrocarbyl substituents may have the same number of carbon atoms or a different number of carbon atoms.

In embodiments, the detergent comprises a salt of a $C_{16}$-$C_{30}$ hydrocarbylbenzenesulfonate having the following structure:

(DT1)

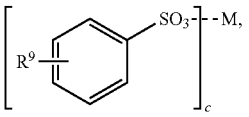

wherein $R^9$ is a monovalent $C_{16}$-$C_{30}$ hydrocarbyl, M is selected from sodium, calcium, magnesium, or barium, c is 1 when M is sodium, and c is 2 when M is calcium, magnesium, or barium. In one embodiment, M is calcium. In another embodiment, $R^9$ is a monovalent $C_{20}$-$C_{24}$ hydrocarbyl. In a still further embodiment, M is calcium, and $R^9$ is a monovalent $C_{20}$-$C_{24}$ hydrocarbyl.

In embodiments, the detergent comprises a mixture of salts of $C_{16}$-$C_{30}$ hydrocarbylbenzenesulfonates having the following structures:

(DT1A)

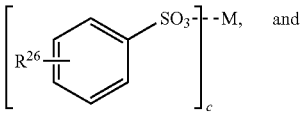

(DT1B)

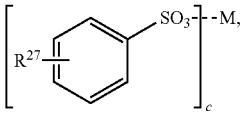

wherein $R^{26}$ is a monovalent $C_{16}$-$C_{30}$ hydrocarbyl, $R^{27}$ is a monovalent $C_{16}$-$C_{30}$ hydrocarbyl, $R^{26}$ and $R^{27}$ include different numbers of carbon atoms, M is selected from sodium, calcium, magnesium, or barium, c is 1 when M is sodium, and c is 2 when M is calcium, magnesium, or barium. In one embodiment, M is calcium. In another embodiment, $R^{26}$ is a monovalent $C_{20}$-$C_{24}$ hydrocarbyl, and $R^{27}$ is a monovalent $C_{20}$-$C_{24}$ hydrocarbyl. In a still further embodiment, $R^{26}$ is a monovalent $C_{20}$ hydrocarbyl, and $R^{27}$ is a monovalent $C_{22}$ hydrocarbyl.

In one embodiment, the detergent comprises a salt of a di-hydrocarbyl-substituted benzenesulfonate having the following structure:

(DT2)

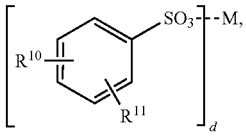

wherein $R^{10}$ is a first monovalent hydrocarbyl, $R^{11}$ is a second monovalent hydrocarbyl, M is selected from sodium, calcium, magnesium, or barium, d is 1 when M is sodium, d is 2 when M is calcium, magnesium, or barium, and the first monovalent hydrocarbyl and the second monovalent hydrocarbyl include a combined total of 16 to 30 carbon atoms. $R^{10}$ and $R^{11}$ may include the same or different number of carbon atoms. In a particular embodiment, the first monovalent hydrocarbyl and the second monovalent hydrocarbyl include a combined total of 20 to 24 carbon atoms. In a further embodiment, the first monovalent hydrocarbyl and the second monovalent hydrocarbyl include the same number of carbon atoms. In a still further embodiment, the first monovalent hydrocarbyl and the second monovalent hydrocarbyl include a combined total of 20, 22, or 24 carbon atoms, and the first monovalent hydrocarbyl and the second monovalent hydrocarbyl include the same number of carbon atoms.

In one embodiment, the detergent is a combination of at least one compound of formula DT1 and at least one compound of formula DT2.

The detergent may be a phenate detergent. The phrase "phenate detergent," as used herein refers to a detergent that includes at least one phenate anion upon exposing a precursor to a base, such as NaOH, and/or an alkaline material, such as calcium oxide. The phenate detergents may be mono-, di-, or tri-substituted with hydrocarbyls, each hydrocarbyl independently having a molecular weight of about 100 to about 500. The substituents may be present at the ortho-position, the meta-position, the para-position, or a combination thereof. The phenate detergents also can include dimers. In the dimers, two phenate moieties may be bonded to each other by a divalent alkylene, sulfanyl, di-sulfanyl, tri-sulfanyl, tetra-sulfanyl, or penta-sulfanyl moiety.

In one embodiment, the detergent comprises a phenate derived from a precursor having the following structure:

(DT3)

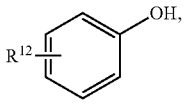

wherein $R^{12}$ is a monovalent hydrocarbyl having a molecular weight of about 100 to about 500.

In one embodiment, the detergent is a combination of at least one compound of formula DT1 and at least one phenate derived from formula DT3. In another embodiment, the detergent is a combination of at least one compound of formula DT2 and at least one phenate derived from formula DT3. In yet another embodiment, the detergent is a combination of at least one compound of formula DT1, at least one compound of formula DT2, and at least one phenate derived from formula DT3.

In one embodiment, the detergent comprises a phenate derived from a precursor having the following structure:

(DT4)

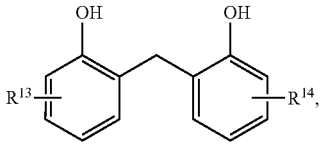

wherein $R^{13}$ and $R^{14}$ are independently selected from a monovalent hydrocarbyl having a molecular weight of about 100 to about 500. In a particular embodiment, $R^{13}$ and $R^{14}$ are hydrocarbyls having at least substantially the same molecular weight.

In one embodiment, the detergent is a combination of [1] at least one compound of formula DT1, at least one compound of formula DT2, or at least one phenate derived from a compound of formula DT3, and [2] at least one phenate derived from a compound of formula DT4. In another embodiment, the detergent is a combination of at least one compound of formula DT1, at least one compound of formula DT2, and at least one phenate derived from a compound of formula DT4. In a further embodiment, the detergent is a combination of at least one compound of formula DT1, at least one phenate derived from a compound of formula DT3, and at least one phenate derived from a compound of formula DT4. In a particular embodiment, the detergent is a combination of at least one compound of formula DT2, at least one phenate derived from a compound of formula DT3, and at least one phenate derived from a compound of formula DT4. In yet another embodiment, the detergent is a combination of at least one compound of formula DT1, at least one compound of formula DT2, at least one phenate derived from a compound of formula DT3, and at least one phenate derived from a compound of formula DT4.

In one embodiment, the detergent comprises a phenate derived from a precursor having the following structure:

(DT5)

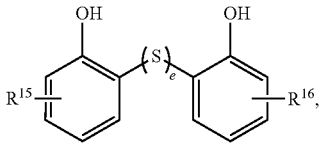

wherein $R^{15}$ and $R^{16}$ are independently selected from a monovalent hydrocarbyl having a molecular weight of about 100 to about 500, and e is 1 to 5. In a particular embodiment, $R^{15}$ and $R^{16}$ are hydrocarbyls having at least substantially the same molecular weight.

In one embodiment, the detergent is a combination of [1] at least one compound of formula DT1, at least one compound of formula DT2, at least one phenate derived from a compound of formula DT3, or at least one phenate derived from a compound of formula DT4, and [2] at least one phenate derived from a compound of formula DT5. In another embodiment, the detergent is a combination of at least one compound of formula DT1, at least one compound of formula DT2, and at least one phenate derived from a compound of formula DT5. In a further embodiment, the detergent is a combination of at least one compound of formula DT1, at least one phenate derived from a compound of formula DT3, and at least one phenate derived from a compound of formula DT5. In a particular embodiment, the detergent is a combination of at least one compound of formula DT1, at least one phenate derived from a compound of formula DT4, and at least one phenate derived from a compound of formula DT5. In embodiments, the detergent is a combination of at least one compound of formula DT2, at least one phenate derived from a compound of formula DT3, and at least one phenate derived from a compound of formula DT5. In some embodiments, the detergent is a combination of at least one compound of formula DT2, at least one phenate derived from a compound of formula DT4, and at least one phenate derived from a compound of formula DT5. In further embodiments, the detergent is a combination of at least one phenate derived from a compound of formula DT3, at least one phenate derived from a compound of formula DT4, and at least one phenate derived from a compound of formula DT5. In a certain embodiment, the detergent is a combination of [1] three of the following: at least one compound of formula DT1, at least one compound of formula DT2, at least one phenate derived from a compound of formula DT3, and at least one phenate derived from a compound of formula DT4, and [2] at least one phenate derived from a compound of formula DT5. In yet another embodiment, the detergent is a combination of at least one compound of formula DT1, at least one compound of formula DT2, at least one phenate derived from a compound of formula DT3, at least one phenate derived from a compound of formula DT4, and at least one phenate derived from a compound of formula DT5.

Additives

The compositions provided herein may include one or more additives. The one or more additives may include at least one diluent, such as a base oil, at least one metal deactivator, at least one viscosity index improver, at least one antioxidant, at least one anti-wear agent, at least one demulsifier, at least one extreme pressure anti-wear agent, at least one friction modifier, at least one foam inhibitor, at least one pour point depressant, or a combination thereof.

In embodiments, the compositions comprise a base oil. Examples of suitable base oils include, but are not limited to, a mineral base oil, such as STAR 4 (Motiva, USA) base oil, a synthetic base oil, such as SPECTRASYN™ PAO 4 (ExxonMobil, USA), or a combination thereof.

In embodiments, the compositions comprise a thiadiazole component, a solubility enhancing component, and a base oil, and the weight ratio of the thiadiazole component to the solubility enhancing component to the base oil is about 40-60:0.1-50:0.1-59.9; about 40-60:10-50:2-40; about 40-60:10-48:2-40; about 40-60:0.1-20:35-55; about 45-55:1-15:40-50; or about 50:1-10:40-50.

In embodiments, the compositions comprise [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or a dispersant and a detergent, and [3] a base oil, and the weight ratio of the thiadiazole component to the solubility enhancing component to the base oil is about 40-60:0.1-50:0.1-59.9; about 40-60:10-50:2-40; about 40-60:10-48:2-40; about 40-60:0.1-20:35-55; about 45-55:1-15:40-50; or about 50:1-10:40-50. In one embodiment, the dispersant is a succinimide dispersant.

In embodiments, the compositions consist essentially of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or a dispersant and a detergent, and [3] a base oil, and the weight ratio of the thiadiazole component to the solubility enhancing component to the base oil is about 40-60:0.1-50:0.1-59.9; about 40-60:10-50:2-40; about 40-60:10-48:2-40; about 40-60:0.1-20:35-55; about 45-55:1-15:40-50; or about 50:1-10:40-50. In one embodiment, the dispersant is a succinimide dispersant.

When used to described the compositions herein, the phrases "consist essentially of" or "consisting essentially of" generally refer to compositions that include the recited elements, or the recited elements and one or more other materials that do not materially affect the basic and novel characteristics of the composition, which may include [1] one or more additives, such as those described herein, e.g., a base oil, metal deactivator, viscosity index improver, etc., [2] one or more unreacted starting materials used to form the thiadiazole component and/or the solubility enhancing component, [3] any liquids in which the thiadiazole component and/or solubility enhancing component were formed, [5] hydrogen peroxide, and [6] any by-products of the reactions used to form the thiadiazole component and/or the solubility enhancing component.

In embodiments, the compositions consist of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or a dispersant and a detergent, and [3] a base oil, and the weight ratio of the thiadiazole component to the solubility enhancing component to the base oil is about 40-60:0.1-50:0.1-59.9; about 40-60:10-50:2-40; about 40-60:10-48:2-40; about 40-60:0.1-20:35-55; about 45-55:1-15:40-50; or about 50:1-10:40-50. In one embodiment, the dispersant is a succinimide dispersant.

Non-limiting examples of metal deactivators include disalicylidene propylenediamine, triazole derivatives, mercaptobenzothiazoles, mercaptobenzimidazoles, and combinations thereof.

Non-limiting examples of viscosity index improvers include polymethacrylate type polymers, ethylene-propylene copolymers, styrene-isoprene copolymers, hydrated styrene-isoprene copolymers, polyisobutylene, dispersant type viscosity index improvers, and combinations thereof.

The at least one anti-oxidant generally may include one or more materials that reduce the tendency of mineral oils to deteriorate while in service, as evidenced by the products of oxidation, such as sludge and varnish-like deposits on metal surfaces, and/or by an increase in viscosity. Examples of anti-oxidants include, but are not limited to, phenol type (phenolic) oxidation inhibitors, such as 4,4'-methylene-bis(2,6-di-tert-butylphenol), 4,4'-bis(2,6-di-tert-butylphenol), 4'-bis(2-methyl-6-tert-butylphenol), 2,2'-methylene-bis(4-methyl-6-tert-butylphenol), 4,4'-butylidene-bis(3-methyl-6-tert-butyl phenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Other types of oxidation inhibitors include metal dithiocarbamate (e.g., zinc dithiocarbamate), and 1,5-ethylenebis(dibutyidithiocarbamate).

The at least one anti-wear agent generally may include one or more agents that reduce wear of moving metallic parts. Examples of such agents include, but are not limited to, phosphates, carbamates, esters, molybdenum complexes, and combinations thereof.

Non-limiting examples of demulsifiers include the addition product of alkylphenol and ethylene oxide, polyoxyethylene alkyl ether, and polyoxyethylene sorbitan ester.

Non-limiting examples of extreme pressure agents and anti-wear agents include zinc dialky-1-dithiophosphate (primary alkyl, secondary alkyl, and aryl type), diphenyl sulfide, methyltrichlorostearate, chlorinated naphthalene, fluoroalkylpolysiloxane, lead naphthenate, neutralized phosphates, dithiophosphates, sulfur-free phosphates, and combinations thereof.

Non-limiting examples of friction modifiers include fatty alcohol, fatty acid, amine, borated ester, other esters, phosphates, phosphites, phosphonates, and combinations thereof.

Non-limiting examples of foam inhibitors include alkyl methacrylate polymers, dimethyl silicone polymers, and combinations thereof.

Non-limiting examples of pour point depressants include polymethyl methacrylate.

Lubricating Compositions, Grease Compositions, and Additive Packages

Also provided herein are lubricating compositions and grease compositions that include one or more of the compositions provided herein. The compositions provided herein may be combined with one or more other materials to form a lubricating composition or a grease composition. The lubricating compositions or grease compositions generally may include one or more of the compositions provided herein in an amount of about 0.01% to about 20%, about 0.05% to about 20%, about 0.05% to about 15%, about 0.05% to about 10%, about 0.05% to about 5%, about 1% to about 5%, or about 1% to about 3% by weight of the lubricating composition or the grease composition, respectively.

In embodiments, the lubricating compositions or grease compositions comprise a first composition comprising [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or the dispersant and the detergent, and [3] a first base oil; and a second base oil; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1, the first base oil is present in the first composition in an amount of about 0.01% to about 80% by weight of the first composition, and the first composition is present in the lubricating composition or the grease composition in an amount of about 0.01% to about 20%, about 0.05% to about 20%, about 0.05% to about 15%, about 0.05% to about 10%, about 0.05% to about 5%, about 1% to about 5%, or about 1% to about 3% by weight of the lubricating composition or the grease composition, respectively. The first base oil and the second base oil may be or include the same base oil(s) or different base oils.

In further embodiments, the lubricating compositions or grease compositions comprise a first composition comprising [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and [2] a solubility enhancing component consisting of a dispersant, a detergent, or the dispersant and the detergent; and a base oil; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis ($C_2$-$C_{30}$ hydrocarbyl-disulfanyl)-1,3,4-thiadiazole is about 20:80 to about 99.9:0.1, and the first composition is present in the lubricating composition or grease composition in an amount of about 0.01% to about 20%, about 0.05% to about 20%, about 0.05% to about 15%, about 0.05% to about 10%, about 0.05% to about 5%, about 1% to about 5%, or about 1% to about 3% by weight of the lubricating composition or the grease composition, respectively.

In embodiments, the lubricating compositions or grease compositions comprise a first composition consisting essentially of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or the dispersant and the detergent, and [3] a first base oil; and a second base oil; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1, the first base oil is present in the first composition in an amount of about 0.01% to about 80% by weight of the first composition, and the first composition is present in the lubricating composition or the grease composition in an amount of about 0.01% to about 20%, about 0.05% to about 20%, about 0.05% to about 15%, about 0.05% to about 10%, about 0.05% to about 5%, about 1% to about 5%, or about 1% to about 3% by weight of the lubricating composition or the grease composition, respectively. The first base oil and the second base oil may be or include the same base oil(s) or different base oils.

In further embodiments, the lubricating compositions or grease compositions comprise a first composition consisting essentially of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and [2] a solubility enhancing component consisting of a dispersant, a detergent, or the dispersant and the detergent; and a base oil; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1, and the first composition is present in the lubricating composition or the grease composition in an amount of about 0.01% to about 20%, about 0.05% to about 20%, about 0.05% to about 15%, about 0.05% to about 10%, about 0.05% to about 5%, about 1% to about 5%, or about 1% to about 3% by weight of the lubricating composition or the grease composition, respectively.

Additive packages also are provided herein. The phrase "additive packages," as used herein, refers to packages that include one or more of the compositions provided herein and one or more additives, such as those provided herein, including at least one viscosity index improver, at least one antioxidant, at least one anti-wear agent, at least one demulsifier, at least one extreme pressure anti-wear agent, at least one friction modifier, at least one foam inhibitor, at least one pour point depressant, at least one dispersant, at least one detergent, or a combination thereof. A composition provided herein may be present in the additive packages in an amount of about 0.05% to about 50% by weight of the additive package.

In embodiments, the additive packages comprise a first composition comprising [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or the dispersant and the detergent, and [3] a first base oil; and one or more additives; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis ($C_2$-$C_{30}$ hydrocarbyl-disulfanyl)-1,3,4-thiadiazole is about 20:80 to about 99.9:0.1, the first base oil is present in the first composition in an amount of about 0.01% to about 80% by weight of the first composition, and the first composition is present in the additive package in an amount of about 0.05% to about 50% by weight of the additive package.

In further embodiments, the additive packages comprise a first composition comprising [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and [2] a solubility enhancing component consisting of a dispersant, a detergent, or the dispersant and the detergent; and one or more additives; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1, and the first composition is present in the additive package in an amount of about 0.05% to about 50% by weight of the additive package.

In embodiments, the additive packages comprise a first composition consisting essentially of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, [2] a solubility enhancing component consisting of a dispersant, a detergent, or the dispersant and the detergent, and [3] a first base oil; and one or more additives; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 20:80 to about 99.9:0.1, the first base oil is present in the first composition in an amount of about 0.01% to about 80% by weight of the first composition, and the first composition is present in the additive package in an amount of about 0.05% to about 50% by weight of the additive package.

In further embodiments, the additive packages comprise a first composition consisting essentially of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and [2] a solubility enhancing component consisting of a dispersant, a detergent, or the dispersant and the detergent; one or more additives; and a base oil; wherein the weight ratio of the solubility enhancing component to the thiadiazole component is about 1:99 to about 90:10, and the weight ratio of the 5-($C_2$-$C_{30}$ hydrocarbyl-disulfanyl)-1,3,4-thiadiazole-2-thiol to the 2,5-bis ($C_2$-$C_{30}$ hydrocarbyl-disulfanyl)-1,3,4-thiadiazole is about 20:80 to about 99.9:0.1, and the first composition is present in the additive package in an amount of about 0.05% to about 50% by weight of the additive package.

Methods

Also provided herein are methods of forming a thiadiazole component, and methods of forming compositions comprising a thiadiazole component and a solubility enhancing component.

In embodiments, the methods of forming a thiadiazole component comprise providing a mixture comprising a $C_2$-$C_{30}$ hydrocarbyl thiol, 2,5-dimercapto-1,3,4-thiadiazole, and a polar liquid, and contacting the mixture with hydrogen peroxide to form the thiadiazole component, wherein the thiadiazole component comprises 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole at a weight ratio of about 20:80 to about 99.9:0.1 of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole. In one embodiment, the molar ratio of the $C_2$-$C_{30}$ hydrocarbyl thiol to the 2,5-dimercapto-1,3,4-thiadiazole in the mixture is about 0.8:1 to about 2:1. In a further embodiment, the molar ratio of the $C_2$-$C_{30}$ hydrocarbyl thiol to the 2,5-dimercapto-1,3,4-thiadiazole in the mixture is about 0.8:1 to about 1.74:1. In another embodiment, the molar ratio of the $C_2$-$C_{30}$ hydrocarbyl thiol to the 2,5-dimercapto-1,3,4-thiadiazole in the mixture is about 1:1 to about 1.8:1. In yet another embodiment, the molar ratio of the $C_2$-$C_{30}$ hydrocarbyl thiol to the 2,5-dimercapto-1,3,4-thiadiazole in the mixture is about 1:1 to about 1.74:1. In a certain embodiment, the molar ratio of the $C_2$-$C_{30}$ hydrocarbyl thiol to the 2,5-dimercapto-1,3,4-thiadiazole in the mixture is about 1:1 to about 1.5:1. In a particular embodiment, the molar ratio of the $C_2$-$C_{30}$ hydrocarbyl thiol to the 2,5-dimercapto-1,3,4-thiadiazole in the mixture is about 1.1:1 to about 1.4:1.

In embodiments, the $C_2$-$C_{30}$ hydrocarbyl thiol comprises a $C_5$-$C_{25}$ hydrocarbyl thiol, a $C_6$-$C_{20}$ hydrocarbyl thiol, or a $C_8$-$C_{18}$ hydrocarbyl thiol. In one embodiment, the $C_2$-$C_{30}$ hydrocarbyl thiol comprises a $C_5$-$C_{25}$ hydrocarbyl thiol, and the thiadiazole component comprises 5-($C_5$-$C_{25}$ hydrocarbyl-disulfanyl)-1,3,4-thiadiazole-2-thiol and 2,5-bis($C_5$-$C_{25}$ hydrocarbyl-disulfanyl)-1,3,4-thiadiazole. In one embodiment, the $C_2$-$C_{30}$ hydrocarbyl thiol comprises a $C_6$-$C_{20}$ hydrocarbyl thiol, and the thiadiazole component comprises 5-($C_6$-$C_{20}$ hydrocarbyl-disulfanyl)-1,3,4-thiadiazole-2-thiol and 2,5-bis($C_6$-$C_{20}$ hydrocarbyl-disulfanyl)-1,3,4-thiadiazole. In one embodiment, the $C_2$-$C_{30}$ hydrocarbyl thiol comprises a $C_8$-$C_{18}$ hydrocarbyl thiol, and the thiadiazole component comprises 5-($C_8$-$C_{18}$ hydrocarbyl-disulfanyl)-1,3,4-thiadiazole-2-thiol and 2,5-bis($C_8$-$C_{18}$ hydrocarbyl-disulfanyl)-1,3,4-thiadiazole.

In embodiments, the $C_2$-$C_{30}$ hydrocarbyl thiol comprises a t-nonylthiol, and the thiadiazole component comprises 5-(t-nonyldisulfanyl)-1,3,4-thiadiazole-2-thiol and 2,5-bis(t-nonyldisulfanyl)-1,3,4-thiadiazole.

In embodiments, the $C_2$-$C_{30}$ hydrocarbyl thiol comprises a t-dodecylthiol, and the thiadiazole component comprises 5-(t-dodecyldisulfanyl)-1,3,4-thiadiazole-2-thiol and 2,5-bis (t-dodecyldisulfanyl)-1,3,4-thiadiazole.

Generally, the polar liquid may be any that permits the at least partial reaction of the starting materials. The polar liquid may comprise water, a $C_1$-$C_{10}$ alcohol, such as ethanol, propanol, butanol, etc., or a combination thereof. In one embodiment, the polar liquid is water. In another embodiment, the polar liquid is a mixture of ethanol and water. The polar liquid also may include THF, ethyl acetate, dimethylformamide (DMF), $C_1$-$C_{10}$ alcohol, water, or a combination thereof.

The contacting step in which the mixture of contacted with hydrogen peroxide generally may be performed at any time, temperature, and pressure that permits the at least partial reaction of the starting materials. In one embodiment, the contacting step is performed at ambient temperature and at ambient pressure. The contacting step may be exothermic, and the temperature may be allowed to rise without limitation, or the rising temperature may be controlled. For example, the rising temperature may be controlled by cooling the reactants, altering the rate at which the reactants contact hydrogen peroxide, or a combination thereof. Upon contacting the reactants with substantially all of the hydrogen peroxide, the reactants may be heated, for example, to reflux. The reactants may be heated for a time of about 30 minutes to about 5 hours. In one embodiment, the reactants are heated to reflux for about 2 hours.

The hydrogen peroxide may be added as an aqueous solution of hydrogen peroxide. The aqueous solution of hydrogen peroxide may have a concentration of hydrogen peroxide of about 10% to about 70% by weight. In one embodiment, the aqueous solution of hydrogen peroxide has a concentration of hydrogen peroxide of about 35% to about 65% by weight.

In embodiments, the methods of forming a composition comprise providing a thiadiazole component comprising 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole at a weight ratio of about 20:80 to about 99.9:0.1 of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole; providing a solubility enhancing component comprising a dispersant, a detergent, or a combination thereof; and combining the thiadiazole component and the solubility enhancing component to form the composition.

The thiadiazole component, the solubility enhancing component, or both the thiadiazole component and the solubility enhancing component may comprise one or more additives. The one or more additives may be a diluent, such as a base oil.

The thiadiazole component and the solubility enhancing component may be combined in any order and by any means known in the art. In one embodiment, combining the thiadiazole component and the solubility enhancing component comprises disposing the thiadiazole component and the solubility enhancing component in a base oil.

It must be noted that, as used in the specification and the appended claims, the singular forms "a," "an," and "the" include plural referents unless the context clearly dictates otherwise. Thus, for example, reference to "an aromatic compound" includes mixtures of aromatic compounds, and the like.

EXAMPLES

The present invention is further illustrated by the following examples, which are not to be construed in any way as imposing limitations upon the scope thereof. On the contrary, it is to be clearly understood that resort may be had to various other aspects, embodiments, modifications, and equivalents thereof which, after reading the description herein, may suggest themselves to one of ordinary skill in the art without departing from the spirit of the present invention or the scope of the appended claims. Thus, other aspects of this invention will be apparent to those skilled in the art from consideration of the specification and practice of the invention disclosed herein.

Example 1

Preparation of Thiadiazole Component with t-Nonyl Thiol

In this example, 7.5 g of 2,5-dimercapto-1,3,4-thiadiazole (hereinafter "DMTD") powder (R. T. Vanderbilt) and 12 g of tert-nonyl thiol (SULFOLE® 90, Chevron Phillips Chemical, USA) were added to a round bottom flask equipped with a thermometer. Therefore, the molar ratio of tert-nonyl thiol to DMTD was 1.5:1.

12.5 mL of ethanol and 12.5 mL of water were added to the round bottom flask. The mixture was stirred. Hydrogen peroxide then was added dropwise to the mixture while stirring.

The reaction was exothermic, and the addition rate was controlled to maintain a temperature below 50° C. When the addition of hydrogen peroxide was completed, the reaction was heated to reflux for 2 h.

The reaction was monitored by Thin Layer Chromatography (TLC). The absence of tert-nonyl thiol indicated the completion of the reaction. The reaction was cooled to ambient temperature, and then was transferred to a separatory funnel and phase separation was allowed.

The bottom phase was collected, and then heated to 120° C. and vacuumed to remove ethanol and water to afford 18 g of a thiadiazole component that included 2,5-bis(tert-nonyl-disulfanyl)-1,3,4-thiazole and 5-(tert-nonyl-disulfanyl)-1,3,4-thiazole-2-thiol.

A solution of 0.5% wt of the thiadiazole component of this example in Motiva STAR 4 base oil was hazy. Similarly, a solution of 0.5% wt of the thiadiazole component product in this example in SPECTRASYN™ PAO 4 (ExxonMobil, USA) base oil was hazy.

Example 2

Preparation of Thiadiazole Component with t-Dodecyl Thiol

In this example, a two-necked 500 mL round bottom flask equipped with a thermometer was charged with 30 g of DMTD, 48.6 g of tert-dodecyl mercaptan, and 100 mL of ethanol. Therefore, in this example, the molar ratio of tert-dodecyl thiol to DMTD was 1.2:1.

The mixture was stirred, and, while stirring, hydrogen peroxide was added dropwise to the mixture. The reaction was exothermic, and the addition rate was controlled to maintain a temperature below 35° C. An ice-bath was used to help control the temperature. When the addition of hydrogen peroxide was complete, the ice-bath was removed.

The reaction then was heated to reflux for 2 h. The reaction was monitored by TLC. When the reaction was complete, the fluid was transferred to a separatory funnel and phase separation was allowed. The bottom phase was collected, and heated to 120° C. and vacuumed to remove ethanol and water to give 75 g of a thiadiazole component that included 2,5-bis(tert-dodecyl-disulfanyl)-1,3,4-thiazole and 5-(tert-dodecyl-disulfanyl)-1,3,4-thiazole-2-thiol.

A solution of 0.5% wt of the thiadiazole component of this example in Motiva STAR 4 base oil was hazy. Similarly, a solution of 0.5% wt of the thiadiazole component of this example in SPECTRASYN™ PAO 4 (ExxonMobil, USA) base oil was hazy.

Example 3

Preparation of Oil-Soluble Yellow Metal Deactivator Compositions

In this example, compositions were prepared that included [1] a succinimide dispersant, specifically IPAC 2310K (International Petroleum Products and Additives Company, Inc.), [2] Motiva STAR 4 base oil, and [3] the thiadizole component of Example 2.

The 100 g compositions of this example were made by blending for 1 hour at ambient temperature the components summarized at Table 1.

TABLE 1

Oil-Soluble Yellow Metal Deactivator Compositions

| Composition No. | Thiadiazole Com. (g) | IPAC 2310K (g) | Motiva STAR 4 (g) |
|---|---|---|---|
| 1 | 50.0 | 1.0 | 49.0 |
| 2 | 50.0 | 2.0 | 48.0 |
| 3 | 50.0 | 5.0 | 45.0 |
| 4 | 50.0 | 10.0 | 40.0 |

Therefore, the weight ratio of IPAC 2310K to the thiadizole component was 1:50, 2:50 (1:25), 5:50 (1:10), and 10:50 (1:5) for Compositions 1, 2, 3, and 4, respectively.

Solutions of 1 weight % of Compositions 1, 2, 3, and 4 in Motiva STAR 4 base oil were all clear. Similarly, solutions of 1 weight % of Compositions 1, 2, 3, and 4 in SPECTRASYN™ PAO 4 (ExxonMobil, USA) base oil also were clear.

Example 4

Preparation of Oil-Soluble Yellow Metal Deactivator Compositions

In this example, compositions were prepared that included [1] a succinimide dispersant, specifically IPAC 2310K (International Petroleum Products and Additives Company, Inc., USA), [2] Motiva STAR 4 base oil, and [3] a thiadizole component prepared according to the procedures of Example 2 with a 1:1 molar ratio of tert-dodecyl thiol and DMTD.

The 100 g compositions of this example were made by blending for 1 hour at ambient temperature the components summarized at Table 2.

TABLE 2

Oil-Soluble Yellow Metal Deactivator Compositions

| Composition No. | Thiadiazole Com. (g) | IPAC 2310K (g) | Motiva STAR 4 (g) |
|---|---|---|---|
| 5 | 50.0 | 10.0 | 40.0 |
| 6 | 50.0 | 25.0 | 25.0 |
| 7 | 50.0 | 48.0 | 2.0 |

Therefore, the weight ratio of IPAC 2310K to the thiadiazole component was 10:50 (1:5 or 16.67:83.33), 25:50 (1:2 or 33.3:66.6), and 48:50 (24:25 or 48.97:51.02) for Compositions 5, 6, and 7, respectively.

Solutions of 1 weight % of Compositions 5, 6, and 7 in Motiva STAR 4 base oil were all clear. Similarly, solutions of 1 weight % of Compositions 5, 6, and 7 in SPECTRASYN™ PAO 4 (ExxonMobil, USA) base oil also were clear.

Example 5

Copper Corrosion Tests

Copper corrosion tests on sulfurized isobutylene (hereinafter "SIB") were conducted pursuant to ASTM D130. The samples of this example were made by top treating 5.0 weight % of SIB in Motiva STAR 4 based oil with a yellow metal deactivator (hereinafter "YMD"). The tests were run at 140° C. for 1 hour. The results of the tests are depicted at Table 3.

TABLE 3

Results of Copper Corrosion Tests

| | YMD | | |
|---|---|---|---|
| YMD Amount (ppm) | 2,5-bis(t-dodecyl-disulfanyl)-1,3,4-thiadiazole | CUVAN ® 484 Alkyl Thiadiazole (Vanderbilt Chemicals, LLC) | Composition 2 (Example 3) |
| 0 | 4a | 4a | 4a |
| 1000 | 4a | 3b | 1b |
| 2000 | 3b | 1b | 1b |

The 2,5-bis(t-dodecyl-disulfanyl)-1,3,4-thiadiazole of this example was made by hydrogen peroxide oxidation of tert-dodecyl thiol with DMTD, as described at Example 2. The molar ratio of tert-dodecyl thiol to DMTD was 2:1.

Example 7

Copper Corrosion Tests

Copper corrosion tests on di-tert-butyl polysulfide (hereinafter "PS") were conducted pursuant to ASTM D130. The samples of this example were made by top treating 5.0 weight % of PS in Motiva STAR 4 based oil with a YMD. The tests were run at 121° C. for 3 hours. The results of the tests are depicted at Table 4.

TABLE 4

Results of Copper Corrosion Tests

| | YMD | |
|---|---|---|
| YMD Amount (ppm) | CUVAN ® 484 Alkyl Thiadiazole (Vanderbilt Chemicals, LLC) | Composition 2 (Example 3) |
| 0 | 4a | 4a |
| 500 | 3b | 1b |

Example 6

Copper Corrosion Tests

Copper corrosion tests on elemental sulfur were conducted pursuant to ASTM D130. The samples of this example were made by top treating 100 ppm of elemental sulfur in Motiva STAR 4 based oil with a YMD. The tests were run at 140° C. for 1.5 hours. The results of the tests are depicted at Table 5.

TABLE 5

Results of Copper Corrosion Tests

| | YMD | |
|---|---|---|
| YMD Amount (ppm) | CUVAN ® 484 Alkyl Thiadiazole (Vanderbilt Chemicals, LLC) | Composition 2 (Example 3) |
| 1000 | 3b | 2b |

We claim:

1. A composition comprising:

a thiadiazole component comprising 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole; and a solubility enhancing component comprising a dispersant, wherein the dispersant comprises a 1-(amino-$C_2$-$C_4$ hydrocarbyl)-3-hydrocarbylpyrrolidine-2,5-dione having the following structure—

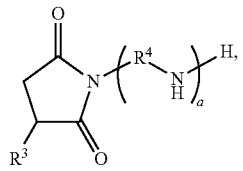

wherein $R^3$ is a monovalent hydrocarbyl having a molecular weight of about 500 to about 2500, $R^4$ is a divalent $C_2$-$C_4$ hydrocarbyl, and a is 1 to 100;

wherein the weight ratio of the solubility enhancing component to the thiadiazole component is about 1:99 to about 10:90, the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 60:40 to about 95:5, and wherein the composition is at least substantially soluble in a group II or a group IV base oil at a concentration of the composition of about 0.01% to about 1% by weight, based on the combined weight of the composition and the base oil.

2. The composition of claim 1, wherein the thiadiazole component comprises 5-($C_8$-$C_{18}$ hydrocarbyl-disulfanyl)-1,3,4-thiadiazole-2-thiol and 2,5-bis($C_8$-$C_{18}$ hydrocarbyl-disulfanyl)-1,3,4-thiadiazole.

3. The composition of claim 1, wherein the thiadiazole component comprises 5-(t-nonyldisulfanyl)-1,3,4-thiadiazole-2-thiol and 2,5-bis(t-nonyldisulfanyl)-1,3,4-thiadiazole.

4. The composition of claim 1, wherein the thiadiazole component comprises 5-(t-dodecyldisulfanyl)-1,3,4-thiadiazole-2-thiol and 2,5-bis(t-dodecyldisulfanyl)-1,3,4-thiadiazole.

5. The composition of claim 1, wherein the solubility enhancing component consists of the dispersant.

6. The composition of claim 1, wherein the dispersant is a borated dispersant, and boron is present in the borated dispersant in an amount of about 0.01% to about 5.0% by weight of the borated dispersant.

7. The composition of claim 1, wherein $R_4$ is a divalent $C_2$ hydrocarbyl.

8. The composition of claim 1, wherein a is 1 to 10.

9. The composition of claim 1, wherein the thiadiazole component consists of the 5-($C_2$-$C_{30}$ hydrocarbyl-disulfanyl)-1,3,4-thiadiazole-2-thiol and the 2,5-bis($C_2$-$C_{30}$ hydrocarbyl-disulfanyl)-1,3,4-thiadiazole, and the solubility enhancing component consists of the dispersant.

10. A lubricating composition or a grease composition comprising:

a first composition consisting essentially of [1] a thiadiazole component consisting of 5-($C_2$-$C_{30}$ hydrocarbyl-disulfanyl)-1,3,4-thiadiazole-2-thiol and 2,5-bis($C_2$-$C_{30}$ hydrocarbyl-disulfanyl)-1,3,4-thiadiazole, and [2] a solubility enhancing component consisting of a dispersant, wherein the dispersant comprises a 1-(amino-$C_2$-$C_4$ hydrocarbyl)-3-hydrocarbylpyrrolidine-2,5-dione having the following structure—

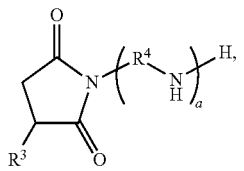

wherein $R^3$ is a monovalent hydrocarbyl having a molecular weight of about 500 to about 2500, $R^4$ is a divalent $C_2$-$C_4$ hydrocarbyl, and a is 1 to 100; and a first base oil, wherein the first composition is at least substantially soluble in the first base oil, and the first base oil comprises a group II base oil or a group IV base oil;

wherein the weight ratio of the solubility enhancing component to the thiadiazole component is about 1:99 to about 10:90, and the weight ratio of the 5-($C_2$-$C_{30}$ hydrocarbyl-disulfanyl)-1,3,4-thiadiazole-2-thiol to the 2,5-bis($C_2$-$C_{30}$ hydrocarbyl-disulfanyl)-1,3,4-thiadiazole is about 60:40 to about 95:5, and the first composition is present in the lubricating composition in an amount of about 0.01% to about 1% by weight of the lubricating composition.

11. The lubricating composition or the grease composition of claim 10, wherein the first composition includes a second base oil that is present in the first composition in an amount of about 0.01% to about 80% by weight of the first composition.

* * * * *